US012416092B2

(12) United States Patent
Tomita et al.

(10) Patent No.: US 12,416,092 B2
(45) Date of Patent: Sep. 16, 2025

(54) PLATING APPARATUS

(71) Applicant: EBARA CORPORATION, Tokyo (JP)

(72) Inventors: Masaki Tomita, Tokyo (JP); Yasuyuki Masuda, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/792,079

(22) PCT Filed: Oct. 28, 2021

(86) PCT No.: PCT/JP2021/039789

§ 371 (c)(1),
(2) Date: Jul. 11, 2022

(87) PCT Pub. No.: WO2023/073860

PCT Pub. Date: May 4, 2023

(65) Prior Publication Data

US 2024/0175165 A1 May 30, 2024

(51) Int. Cl.

| | |
|---|---|
| ***C25D 17/00*** | (2006.01) |
| ***C25D 17/06*** | (2006.01) |
| ***C25D 21/04*** | (2006.01) |
| ***C25D 21/12*** | (2006.01) |

(52) U.S. Cl.

CPC ..... *C25D 17/002* (2013.01); *C25D 17/001* (2013.01); *C25D 17/06* (2013.01); *C25D 21/04* (2013.01); *C25D 21/12* (2013.01)

(58) Field of Classification Search

CPC ..... C25D 17/002; C25D 17/001; C25D 21/04
See application file for complete search history.

(56) References Cited

U.S. PATENT DOCUMENTS

| | | | |
|---|---|---|---|
| 6,821,407 | B1 | 11/2004 | Reid et al. |
| 2004/0262150 | A1 | 12/2004 | Yajima et al. |
| 2022/0356595 | A1 | 11/2022 | Chang et al. |

FOREIGN PATENT DOCUMENTS

| | | | | | |
|---|---|---|---|---|---|
| JP | 2002-004099 | A | | 1/2002 | |
| JP | 2002 97598 | A | * | 4/2002 | ..... C25C 17/001 |
| JP | 2002-275693 | A | | 9/2002 | |
| JP | 2007-169773 | A | | 7/2007 | |
| JP | 2008-019496 | A | | 1/2008 | |
| JP | 6936420 | B1 | | 9/2021 | |
| JP | 6951609 | B1 | | 10/2021 | |
| WO | WO 2004/009879 | A1 | | 1/2004 | |

* cited by examiner

*Primary Examiner* — Ciel P Contreras
(74) *Attorney, Agent, or Firm* — BakerHostetler

(57) ABSTRACT

Provided is a technique that can suppress deterioration of plating quality of a substrate due to gas bubbles that remain entirely on a lower surface of a membrane.

A plating apparatus 1000 includes a plating tank 10, a substrate holder 20, and a membrane module 40. The membrane module includes a first membrane 41 and a second membrane 42. The second membrane has an inflow port 42*c* for causing a plating solution in a first region R1 below the second membrane to flow into a second region R2 above the second membrane and below the first membrane, and an inclined portion 42*b* inclining relative to a horizontal direction and inclining so as to be positioned upward as heading from a center side of an anode chamber to an outer edge side of the anode chamber.

12 Claims, 17 Drawing Sheets

1000

PLATING APPARATUS

TECHNICAL FIELD

The present invention relates to a plating apparatus.

BACKGROUND ART

Conventionally, there has been known what is called a cup type plating apparatus as a plating apparatus that performs a plating process on a substrate (for example, see PTL 1 and PTL 2). Such a plating apparatus includes a plating tank in which an anode is arranged, and a substrate holder that is arranged above the anode and holds a substrate as a cathode such that a plating surface of the substrate is opposed to the anode. Additionally, such a plating apparatus has a membrane, such as an ion exchange membrane, at a position above the anode and below the substrate inside the plating tank. This membrane partitions the inside of the plating tank into an anode chamber below the membrane and a cathode chamber above the membrane. The above-described anode is arranged in the anode chamber. During a plating process on the substrate, the substrate is arranged in the cathode chamber.

CITATION LIST

Patent Literature

PTL 1: Japanese Unexamined Patent Application Publication No. 2008-19496
PTL 2: U.S. Pat. No. 6,821,407

SUMMARY OF INVENTION

Technical Problem

In the cup type plating apparatus having the membrane as described above, gas bubbles are possibly generated in the anode chamber for some reason. When the gas bubbles are thus generated in the anode chamber and the gas bubbles remain entirely on a lower surface of the membrane, plating quality of the substrate possibly deteriorates due to the gas bubbles.

The present invention has been made in view of the above, and one of the objects of the present invention is to provide a technique that can suppress deterioration of plating quality of a substrate due to gas bubbles that remain entirely on a lower surface of a membrane.

Solution to Problem (Aspect 1) To achieve the above-described object, a plating apparatus according to one aspect of the present invention includes a plating tank, a substrate holder, and a membrane module. The plating tank has a bottom wall and an outer peripheral wall extending upward from an outer edge of the bottom wall. The plating tank is configured to accumulate a plating solution and have an anode arranged therein. The substrate holder is arranged above the anode. The substrate holder is configured to hold a substrate as a cathode such that the substrate is opposed to the anode. The membrane module is arranged above the anode and below the substrate. The membrane module includes a first membrane configured to partition an inside of the plating tank into an anode chamber and a cathode chamber below the anode chamber, and a second membrane arranged at a position below the first membrane and above the anode without contacting the first membrane. The second membrane has an inflow port for causing a plating solution in a first region below the second membrane to flow into a second region above the second membrane and below the first membrane, and an inclined portion inclining relative to a horizontal direction and inclining so as to be positioned upward as heading from a center side of the anode chamber to an outer edge side of the anode chamber.

With this aspect, the second membrane as described above is included, and therefore, even when gas bubbles are generated in the anode chamber, the gas bubbles can be moved along the inclined portion of the second membrane using buoyancy and moved to an outer edge of the inclined portion of the second membrane. This can suppress remaining of the gas bubbles generated in the anode chamber entirely on lower surfaces of the first membrane and the second membrane. As a result, deterioration of plating quality of the substrate due to the gas bubbles remaining entirely on the lower surfaces of the first membrane and the second membrane can be suppressed.

(Aspect 2) In the aspect 1 described above, the first membrane may include an extending portion extending in the horizontal direction, and inclined portions extending from the extending portion as a starting point to one side and another side in a direction away from the extending portion and inclining so as to be positioned upward as separating from the extending portion.

(Aspect 3) In the aspect 2 described above, the outer peripheral wall of the plating tank may be provided with a drain port for discharging a plating solution in the cathode chamber from the cathode chamber, and the drain port may be disposed such that a height from the extending portion of the first membrane to the drain port is within 20 mm.

With this aspect, the plating solution in the cathode chamber can be easily discharged from the cathode chamber.

(Aspect 4) In any one of the aspects 1 to 3 described above, the membrane module may further include a second membrane support member configured to support the second membrane.

(Aspect 5) In any one of the aspects 1 to 4 described above, the membrane module may further include a first membrane support member configured to support the first membrane.

(Aspect 6) In any one of the aspects 1 to 5 described above, the plating apparatus may further include a housing groove formed in the outer peripheral wall of the plating tank so as to be along an outer edge of the inclined portion of the second membrane. The housing groove may be configured to temporarily house gas bubbles moved to the outer edge of the inclined portion of the second membrane and configured to cause a plating solution in the first region and a plating solution in the second region to join together in the housing groove. The plating apparatus may further include an anode chamber discharge port communicating with the housing groove. The anode chamber discharge port is configured to suction the gas bubbles housed in the housing groove together with a plating solution flowing through the housing groove and discharge the gas bubbles and the plating solution to an outside of the plating tank.

With this aspect, the gas bubbles moved to the outer edge of the inclined portion of the second membrane can be temporarily housed in the housing groove, and the housed gas bubbles can be discharged to the outside of the plating tank together with the plating solutions in the first region and the second region via the anode chamber discharge port. This can effectively suppress remaining of the gas bubbles on a lower surface of the second membrane. The gas bubbles are temporarily housed in the housing groove, thereby allowing a plurality of small gas bubbles to be joined and made into large gas bubbles in the housing groove. This can make it easier to discharge the gas bubbles from the anode chamber discharge port.

(Aspect 7) In any one of the aspects 1 to 6 described above, the plating apparatus may further include an ionically resistive element arranged below the substrate in the cathode chamber, and a ring-shaped electric field adjusting block for adjusting an electric field in the cathode chamber The electric field adjusting block is arranged below the ionically resistive element in the cathode chamber and above the membrane module. The ionically resistive element may be provided with a plurality of through holes disposed so as to pass through a lower surface and an upper surface of the ionically resistive element. The electric field adjusting block may have an inner diameter smaller than an outer diameter of a punching area as an area where the plurality of through holes are disposed in the ionically resistive element.

With this aspect, homogenization of a film thickness of a plating film formed on the substrate can be ensured by the ionically resistive element. Additionally, since the electric field in the cathode chamber can be adjusted by the electric field adjusting block, the homogenization of the film thickness of the plating film can be effectively ensured.

(Aspect 8) In any one of the aspects 1 to 7 described above, the plating apparatus may further include a suppressing member configured to suppress flowing of gas bubbles in the first region into the inflow port.

With this aspect, flowing of the gas bubbles in the first region into the second region from the inflow port can be suppressed.

(Aspect 9) In the aspect 8 described above, the suppressing member may include a suppressing plate arranged below the inflow port of the second membrane and extending in a horizontal direction.

(Aspect 10) In the aspect 8 described above, the suppressing member may include a tubular member arranged below the inflow port of the second membrane and extending in a horizontal direction, and a coupling member configured to couple an inside of the tubular member to the inflow port.

(Aspect 11) In anyone of the aspects 1 to 10 described above, the plating apparatus may further include a plating solution circulation module configured to circulate a plating solution between the anode chamber and a reservoir tank for anode chamber and circulate a plating solution between the cathode chamber and a reservoir tank for cathode chamber in performing a plating process on the substrate.

(Aspect 12) In the aspect 11 described above, the plating solution circulation module may include a pressure regulating valve arranged in a flow passage configured to circulate a plating solution in the anode chamber to the reservoir tank for anode chamber, the pressure regulating valve being configured to regulate a pressure in the anode chamber such that the pressure in the anode chamber has a value identical to a value of a pressure in the cathode chamber.

With this aspect, the pressure in the anode chamber can be controlled to have the value identical to the value of the pressure in the cathode chamber with a simple configuration.

DESCRIPTION OF EMBODIMENTS

Embodiment 1

The following describes Embodiment 1 of the present invention with reference to the drawings. Note that the drawings are schematically illustrated to facilitate understanding of features, and dimensional proportions and the like of each constituent element are not necessarily the same as the actual ones. In some drawings, orthogonal coordinates of X-Y-Z are illustrated for reference. Of the orthogonal coordinates, the Z-direction corresponds to an upper side, and the −Z-direction corresponds to a lower side (a direction in which gravity acts).

Figure 1:
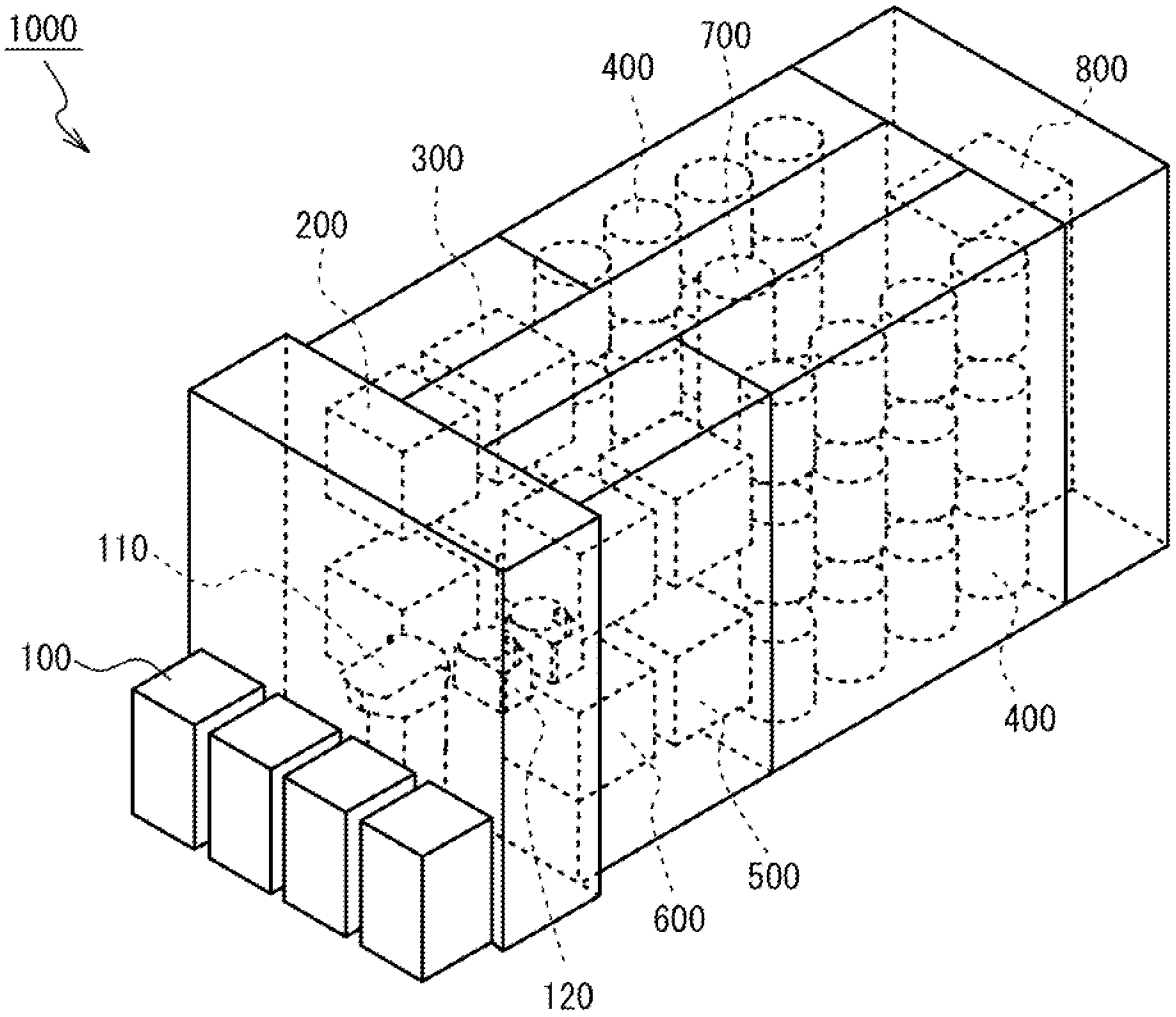
FIG. 1 is a perspective view illustrating an overall configuration of a plating apparatus according to Embodiment 1.
Figure 2:
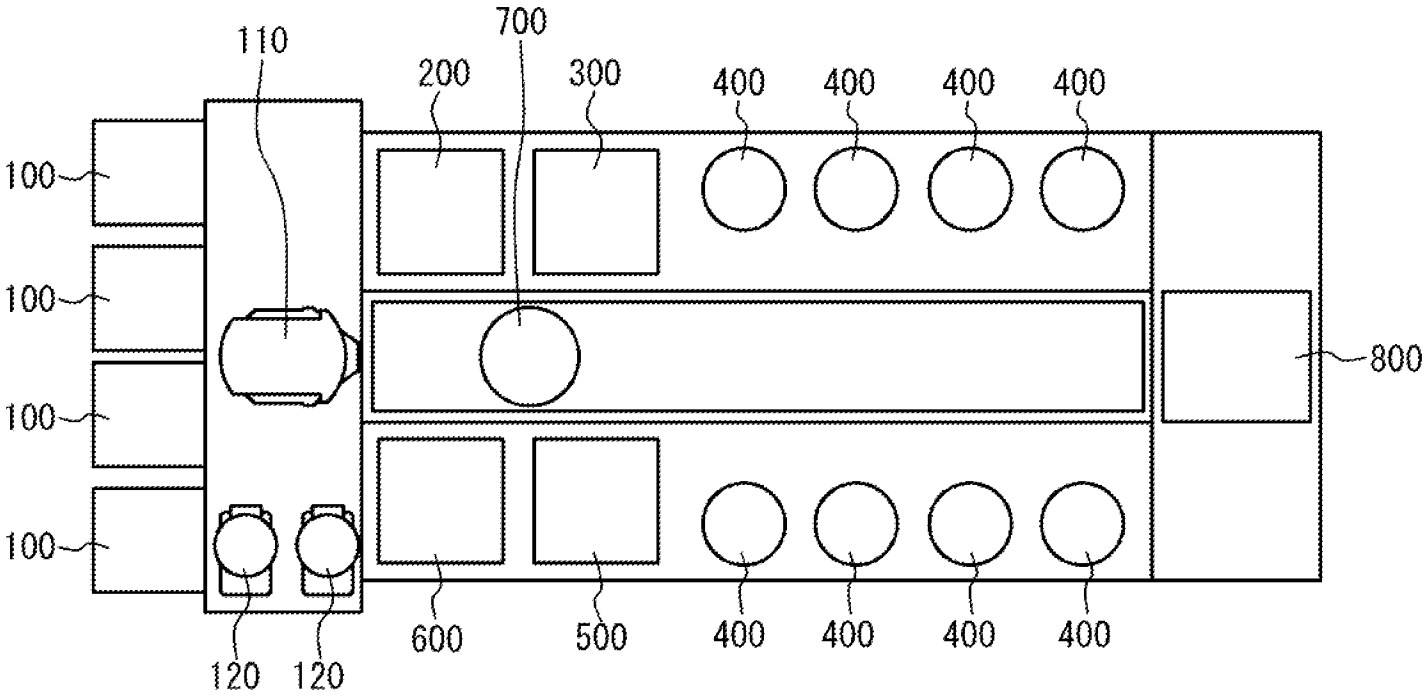
FIG. 2 is a top view illustrating the overall configuration of the plating apparatus according to Embodiment 1.

FIG. 1 is a perspective view illustrating the overall configuration of a plating apparatus 1000 of this embodiment. FIG. 2 is a top view illustrating the overall configuration of the plating apparatus 1000 of this embodiment. As illustrated in FIGS. 1 and 2, the plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, the pre-wet module 200, and the spin rinse dryers 600. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers 600 are disposed to be arranged in the vertical direction in this embodiment, the number of spin rinse dryers 600 and arrangement of the spin rinse dryers 600 are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the pre-wet nodule 200.

The pre-wet module 200 performs the pre-wet process on the substrate. The transfer device 700 transfers the substrate on which the pre-wet process has been performed to the pre-soak nodule 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer robot 110 receives the substrate from the spin rinse dryer 600 and transfers the substrate, on which the drying process is performed, to the cassette at the load port 100. Finally, the cassette housing the substrate is unloaded from the load port 100.

Note that the configuration of the plating apparatus 1000 described in FIG. 1 and FIG. 2 is merely an example, and the configuration of the plating apparatus 1000 is not limited to the configuration in FIG. 1 and FIG. 2.

Subsequently, the plating modules 400 will be described. Note that since a plurality of the plating modules 400 included in the plating apparatus 1000 according to this embodiment have the identical configuration, one of the plating modules 400 will be described.

Figure 3:
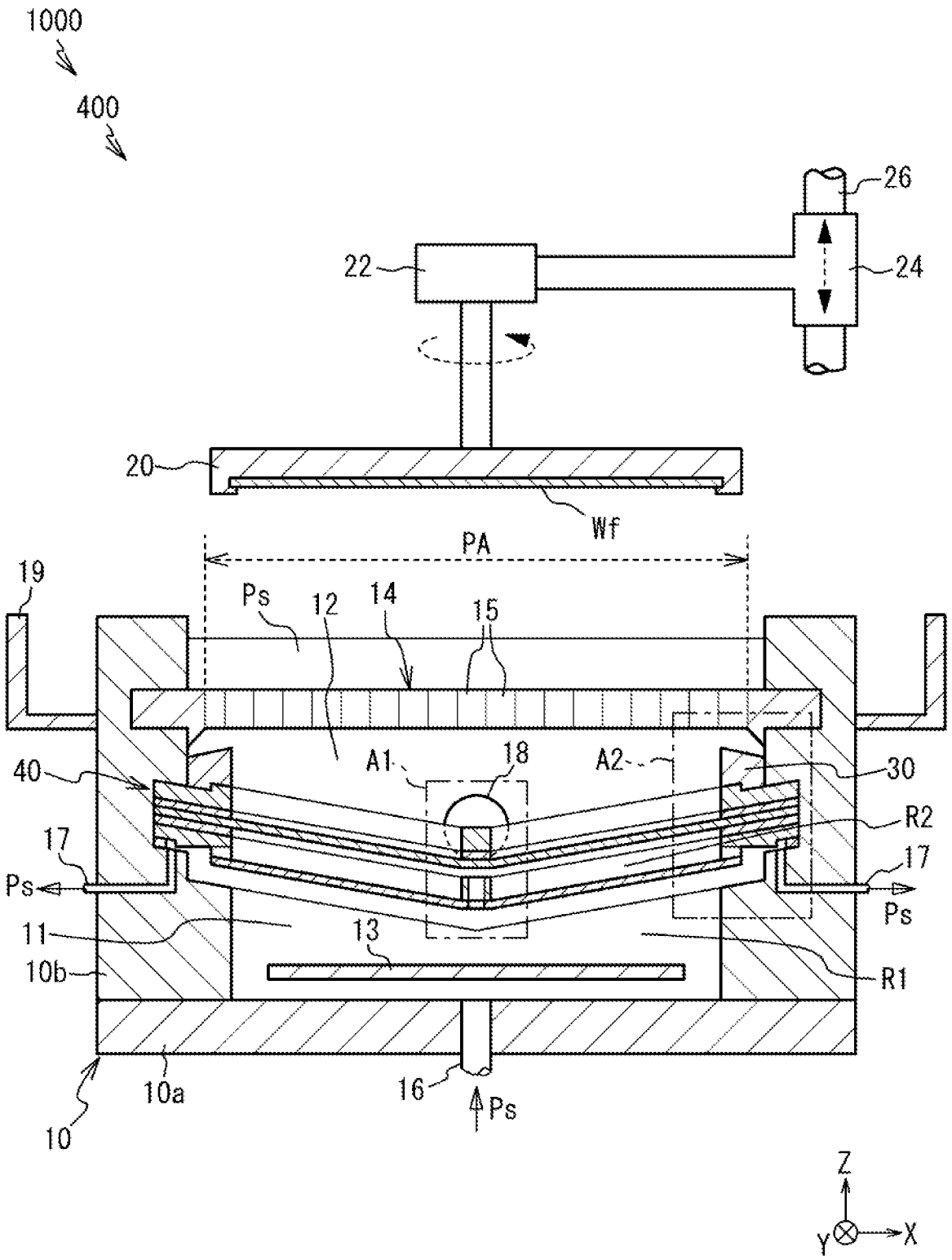
FIG. 3 is a drawing schematically illustrating a configuration of a plating module according to Embodiment 1.

FIG. 3 is a drawing schematically illustrating a configuration of one plating module 400 in the plating apparatus 1000 according to this embodiment. The plating apparatus 1000 according to this embodiment is a cup type plating apparatus. The plating module 400 of the plating apparatus 1000 according to this embodiment includes a plating tank 10, a substrate holder 20, a rotation mechanism 22, an elevating mechanism 24, an electric field adjusting block 30, and a membrane module 40.

The plating tank 10 is configured of a container with a bottom having an opening on an upper side. Specifically, the plating tank 10 has a bottom wall 10*a* and an outer peripheral wall 10*b* extending upward from an outer edge of the bottom wall 10*a*, and an upper portion of the outer peripheral wall 10*b* is open. Although the shape of the outer peripheral wall 10*b* of the plating tank 10 is not particularly limited, the outer peripheral wall 10*b* according to this embodiment has a cylindrical shape as an example. In the inside of the plating tank 10, a plating solution Ps is accumulated. On an outer side of the outer peripheral wall 10*b* of the plating tank 10, an overflow tank 19 for accumulating the plating solution Ps overflowing from an upper end of the outer peripheral wall 10*b* is arranged.

It is only necessary for the plating solution Ps to be a solution including ions of a metallic element constituting a plating film, and a specific example of the plating solution Ps is not particularly limited. In this embodiment, a copper plating process is used as an example of the plating process, and a copper sulfate solution is used as an example of the plating solution Ps.

Further, in this embodiment, a predetermined plating additive is included in the plating solution Ps. As a specific example of the predetermined plating additive, in this embodiment, a "nonionic plating additive" is used. The nonionic plating additive means an additive that does not exhibit an ionic character in the plating solution Ps.

In the inside of the plating tank 10, an anode 13 is arranged. The anode 13 is arranged so as to extend in the horizontal direction. A specific type of the anode 13 is not particularly limited, and it may be an insoluble anode or may be a soluble anode. In this embodiment, an insoluble anode is used as an example of the anode 13. A specific type of the insoluble anode is not particularly limited, and platinum, iridium oxide, and the like can be used. Between the anode 13 and a second membrane 42 of the membrane module 40 described later, an anode mask may be arranged.

In a cathode chamber 12 described later inside the plating tank 10, an ionically resistive element 14 is arranged. Specifically, the ionically resistive element 14 is disposed at a position above the membrane module 40 in the cathode chamber 12 and below a substrate Wf. The ionically resistive element 14 is a member that can be a resistance to movement of ions in the cathode chamber 12 and is disposed to ensure homogenization of an electric field formed between the anode 13 and the substrate Wf.

The ionically resistive element 14 is configured of a plate member having a plurality of through holes 15 disposed so as to pass through to lower surface and an upper surface of the ionically resistive element 14. The plurality of through holes 15 are disposed at a part of a punching area PA (which is a circular area in top view) of the ionically resistive element 14. While a specific material of the ionically resistive element 14 is not particularly limited, in this embodiment, a resin, such as polyetheretherketone, is used as an example.

The plating module 400 has the ionically resistive element 14, thereby ensuring homogenization of a film thickness of a plating film (a plated layer) formed on the substrate Wf.

The electric field adjusting block 30 is configured of a ring-shaped member. The electric field adjusting block 30 is arranged below the ionically resistive element 14 in the cathode chamber 12 and above the membrane module 40. Specifically, the electric field adjusting block 30 according to this embodiment is arranged on an upper surface of a first support member 43 described later.

Figure 13:
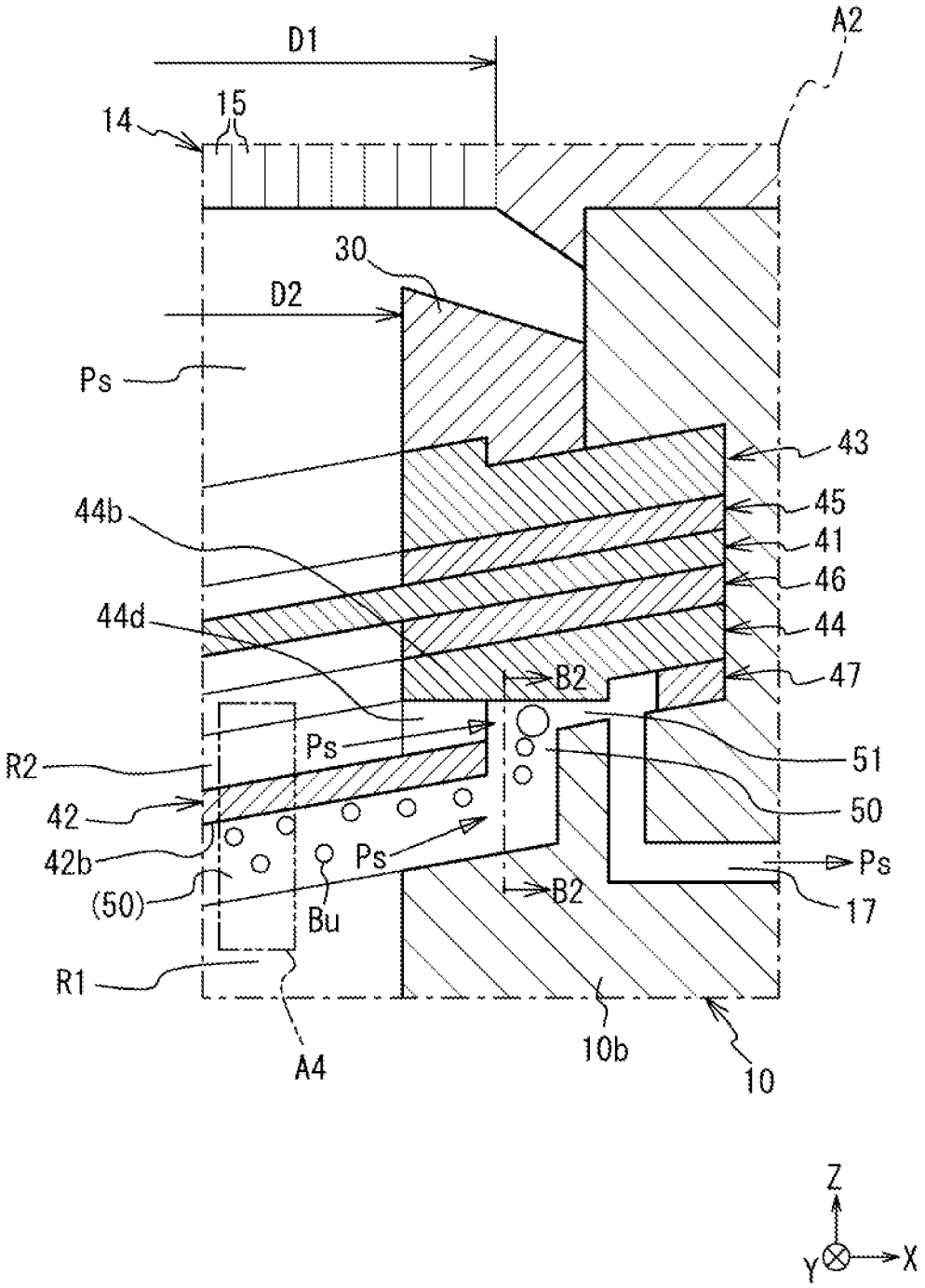
FIG. 13 is a schematic enlarged cross-sectional view of a part A2 of FIG. 3.

As illustrated in FIG. 13 described later, an inner diameter D2 of an inner peripheral wall of the electric field adjusting block 30 is a value smaller than an outer diameter D1 of the punching area PA of the ionically resistive element 14. In other words, the inner peripheral wall of the electric field adjusting block 30 is positioned on an inner side in the radial direction of the ionically resistive element 14 with respect to the through hole 15 positioned on the outermost side in the radial direction of the ionically resistive element 14.

The electric field adjusting block 30 has a function of adjusting the electric field in the cathode chamber 12. Specifically, the electric field adjusting block 30 suppresses concentration of the electric field on an outer edge of the substrate Wf and adjusts the electric field in the cathode chamber 12 such that the film thickness of the plating film formed on the substrate Wf is homogenized. While a specific material of the electric field adjusting block 30 is not particularly limited, in this embodiment, a resin, such as polyetheretherketone, is used as an example.

Since the electric field in the cathode chamber 12 can be adjusted by including the electric field adjusting block 30 in the plating module 400, the homogenization of the film thickness of the plating film can be effectively ensured.

Note that it is preferred to preliminarily prepare a plurality of kinds of electric field adjusting blocks 30 having different inner diameters D2. In this case, it is only necessary to select an electric field adjusting block 30 having a desired inner diameter D2 among the plurality of kinds of electric field adjusting blocks 30 and to arrange the selected electric field adjusting block 30 in the plating tank 10.

The ionically resistive element 14 or the electric field adjusting block 30 described above are not essential members in this embodiment, and the plating module 400 can be configured not to include these members.

With reference to FIG. 3, inside the plating tank 10, the membrane module 40 is arranged at a position between the anode 13 and the substrate Wf (a cathode) (specifically, at a position between the anode 13 and the ionically resistive element 14 in this embodiment). Inside the plating tank 10, a region below a first membrane 41 described later of the membrane module 40 is referred to as an anode chamber 11, and a region above the first membrane 41 is referred to as the cathode chamber 12. The above-described anode 13 is arranged in the anode chamber 11. Details of the membrane module 40 will be described later.

The substrate holder 20 holds the substrate Wf as the cathode such that a surface to be plated (a lower surface) of the substrate Wf is opposed to the anode 13. The substrate holder 20 is connected to the rotation mechanism 22. The rotation mechanism 22 is a mechanism for rotating the substrate holder 20. The rotation mechanism 22 is connected to the elevating mechanism 24. The elevating mechanism 24 is supported by a support pillar 26 extending in the vertical direction. The elevating mechanism 24 is a mechanism for moving up and down the substrate holder 20 and the rotation mechanism 22. The substrate Wf and the anode 13 are electrically connected to an energization device (not illustrated). The energization device is a device for flowing electricity between the substrate Wf and the anode 13 in performing the plating process.

In the plating tank 10, an anode chamber supply port 16 for supplying the plating solution Ps to the anode chamber 11 and anode chamber discharge ports 17 for discharging the plating solution Ps from the anode chamber 11 to an outside of the plating tank 10 are disposed. The anode chamber supply port 16 according to this embodiment is arranged in the bottom wall 10*a* of the plating tank 10 as an example. The anode chamber discharge ports 17 are arranged in the outer peripheral wall 10*b* of the plating tank 10 as an example. The anode chamber discharge ports 17 are disposed at two positions in the plating tank 10. Details of the anode chamber discharge port 17 will be described later.

The plating solution Ps discharged from the anode chamber discharge ports 17 is temporarily accumulated in a reservoir tank: for anode chamber, and then supplied from the anode chamber supply port 16 to the anode chamber 11 again. Details of a circulation aspect of the plating solution Ps will be described in another embodiment (Embodiment 3) described later.

In the plating tank 10, a supply/drain port 18 for the cathode chamber 12 is disposed. The supply/drain port 18 is a combination of a "supply port of the plating solution Ps for the cathode chamber 12" and a "drain poet of the plating solution Ps for the cathode chamber 12".

That is, when the plating solution Ps is supplied to the cathode chamber 12, the supply/drain port 18 functions as the "supply port of the plating solution Ps for the cathode chamber 12", and the plating solution Ps is supplied from the supply/drain port 18 to the cathode chamber 12. On the other hand, when the plating solution Ps is discharged from the cathode chamber 12, the supply/drain port 18 functions as the "drain port of the plating solution Ps for the cathode chamber 12", and the plating solution Ps in the cathode chamber 12 is discharged from the supply/drain port 18.

Specifically, a flow passage switching valve (not illustrated) is connected to the supply/drain port 18 according to this embodiment. By switching a flow passage by the flow passage switching valve, the supply/drain port 18 selectively performs supplying the plating solution Ps to the cathode chamber 12 and discharging the plating solution Ps in the cathode chamber 12 to the outside of the plating tank 10.

Figure 4:
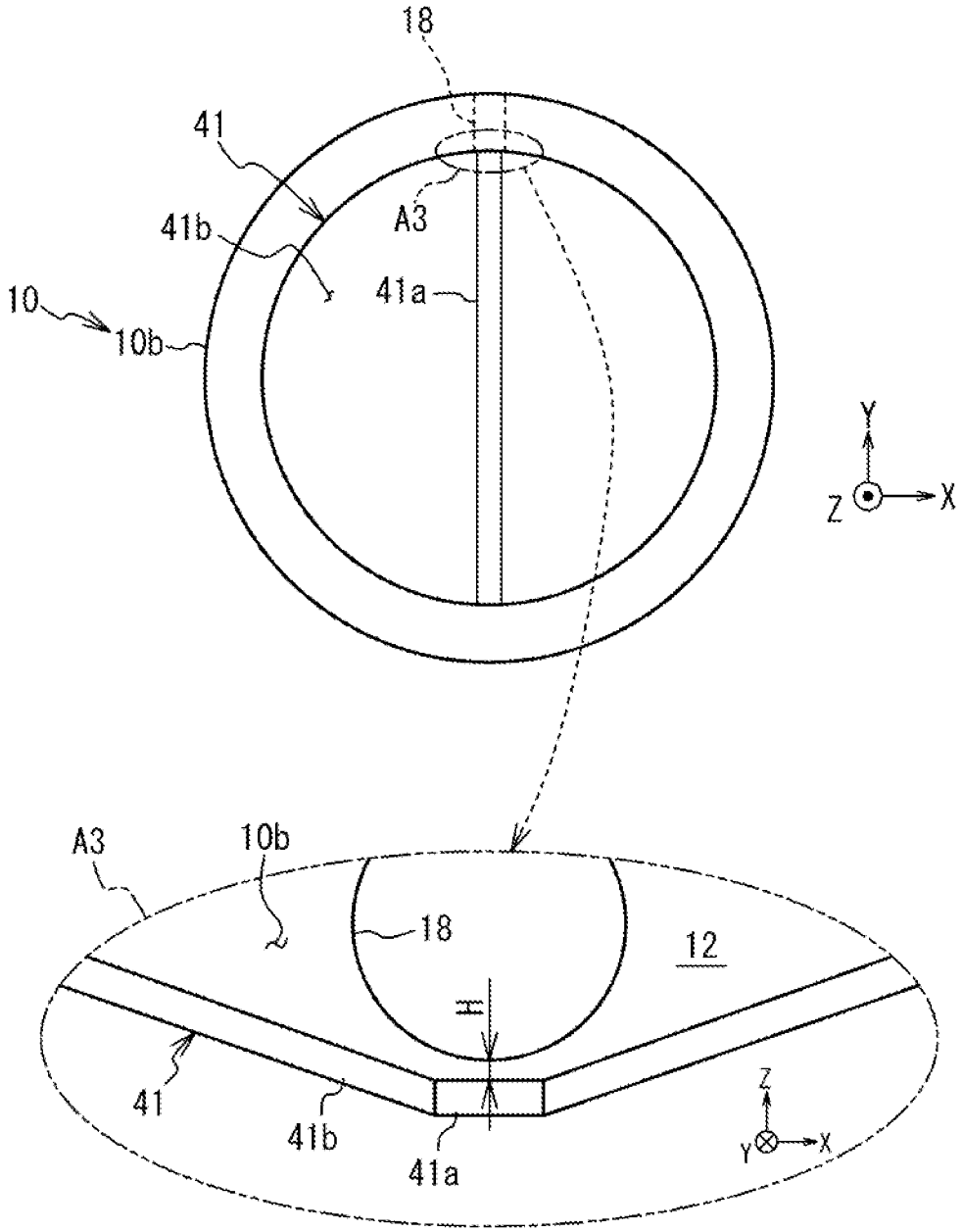
FIG. 4 is a schematic diagram for describing details of a supply/drain port according to Embodiment 1.

FIG. 4 is a schematic diagram for describing details of the supply/drain pout 18. Specifically, in FIG. 4, a schematic top view of the plating tank 10 is illustrated, and in a part (a part A3) of FIG. 4, a schematic front view of a peripheral configuration of the supply/drain port 18 is also illustrated. In FIG. 4, illustration of the ionically resistive element 14, the electric field adjusting block 30, and the first support member 43 and a first sealing member 45 that are described later is omitted.

As illustrated in FIG. 4, the supply/drain port 18 according to this embodiment is disposed in the outer peripheral wall 10*b* of the plating tank 10. The supply/drain port 18 is disposed such that a height (H) from an extending portion 41*a* of the first membrane 41 described later to the supply/drain port 18 is within 20 min. That is, the height (H) may be 0 mm (in this case, the supply/drain port 18 is arranged immediately above the extending portion 41*a* of the first membrane 41), may be 20 mm, or may be an arbitrary value selected from a range larger than 0 mm and smaller than 20 mm.

With this configuration, the plating solution Ps in the cathode chamber 12 can be easily discharged from the cathode chamber 12.

Note that the configuration of the supply/drain port 18 is not limited to the above-described configuration. To give another example, the plating module 400 may individually include the "supply port of the plating solution Ps for the cathode chamber 12" and the "drain port of the plating solution Ps for the cathode chamber 12" instead of the supply/drain poet 18.

When the plating process is performed on the substrate Wf first, the rotation mechanism 22 rotates the substrate holder 20 while the elevating mechanism 24 moves the substrate holder 20 downward to immerse the substrate Wf in the plating solution Ps in the plating tank 10 (the plating solution Ps in the cathode chamber 12). Next, electricity is flowed between the anode 13 and the substrate Wf by the energization device. This forms the plating film on the surface to be plated of the substrate Wf.

In performing the plating process on the substrate Wf, the supply/drain port 18 does not fulfill the function as the "drain port of the plating solution Ps for the cathode chamber 12". Specifically, in performing the plating process, the plating solution Ps in the cathode chamber 12 overflows from the upper end of the outer peripheral wall 10*b* of the plating tank 10 and is temporarily accumulated in the overflow tank 19. After completion of the plating process, when the plating solution Ps in the cathode chamber 12 is discharged from the cathode chamber 12 to empty the plating solution Ps out of the cathode chamber 12, the supply, drain port 18 enters a valve-opening state and functions as the "drain port of the plating solution Ps for the cathode chamber 12" to discharge the plating solution Ps from the supply/drain port 18.

In the cup type plating apparatus 1000 as described in this embodiment, gas bubbles Bu (this reference numeral is mentioned in FIG. 13 described later) are possibly generated in the anode chamber 11 for some reason. Specifically, as described in this embodiment, when an insoluble anode is used as the anode 13, oxygen ($O_2$) is generated in the anode chamber 11 based on the following reaction equation in performing the plating process (in applying current). In this case, the generated oxygen becomes the gas bubbles Bu.

$$2H_2O \rightarrow O_2 + 4H^+ + 4e^-$$

If a soluble anode is used as the anode 13, the above reaction equation does not occur. However, for example, when the plating solution Ps is first supplied to the anode chamber 11, air possibly flows into the anode chamber 11 together with the plating solution Ps. Accordingly, when a soluble anode is used as the anode 13, the gas bubbles Bu may also be generated in the anode chamber 11.

As described above, in a case where the gas bubbles Bu are generated in the anode chamber 11, if the gas bubbles Bu remain entirely on a lower surface of the membrane module 40 (specifically, a lower surface of the second membrane 42 described later), the gas bubbles Bu possibly cut off the electric field. In this case, plating quality of the substrate Wf possibly deteriorates. Therefore, in this embodiment, a technique that will be described in the following is used to deal with such a problem.

Figure 5:
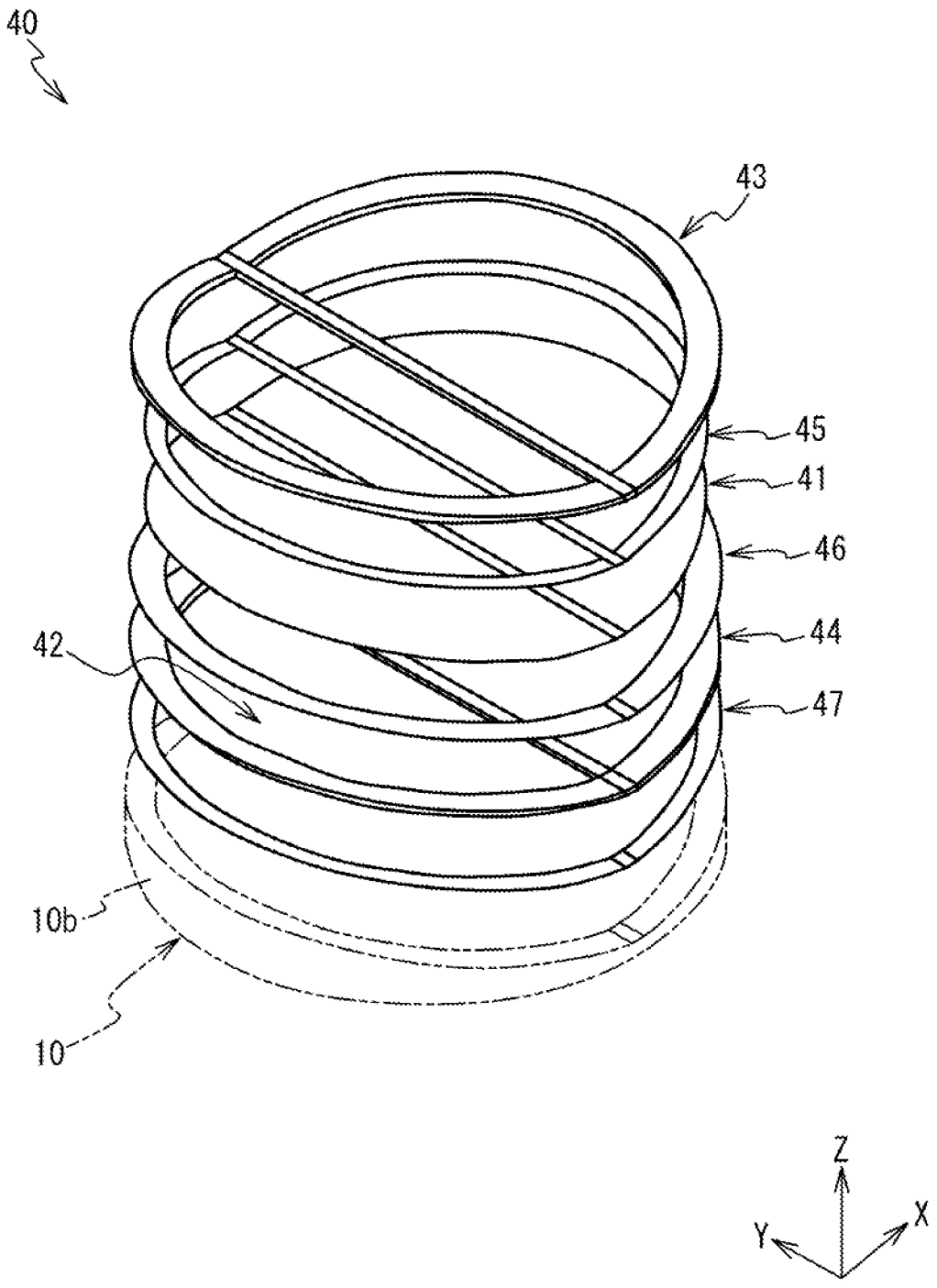
FIG. 5 is a schematic exploded perspective view of a membrane module according to Embodiment 1.
Figure 6:
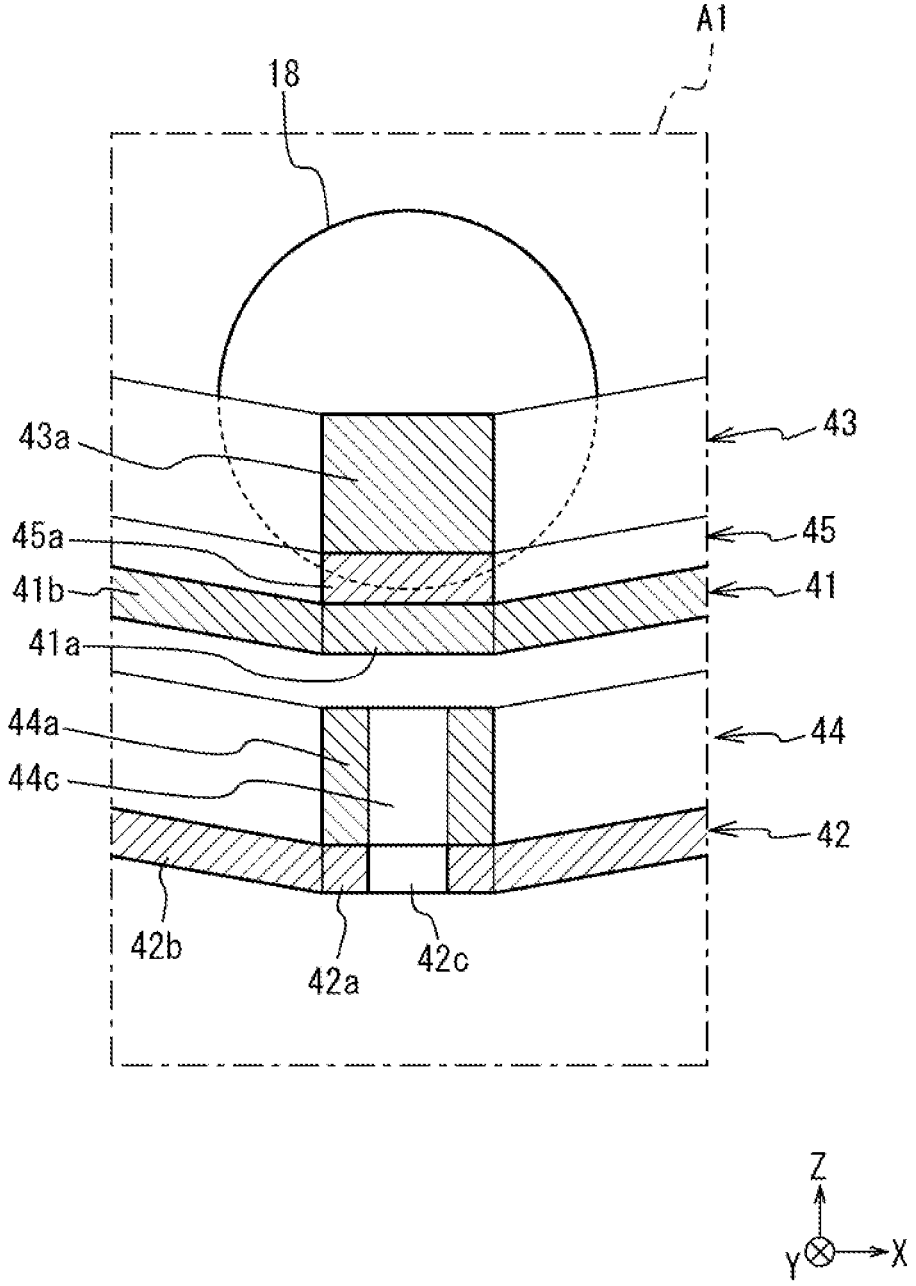
FIG. 6 is a schematic enlarged cross-sectional view of a part A1 of FIG. 3.

FIG. 5 is a schematic exploded perspective view of the membrane module 40. FIG. 6 is a schematic enlarged cross-sectional view of a part A1 of FIG. 3. The membrane module 40 according to this embodiment includes the first membrane 41, the second membrane 42, the first support member 43 (that is, a "first membrane support member"), a second support member 44 (that is, a "second membrane support member"), the first sealing member 45, a second sealing member 46, and a third sealing member 47. These constituting members of the membrane module 40 are secured to a predetermined position of the outer peripheral wall 10*b* of the plating tank 10 (that is, a secured position to which the membrane module 40 is secured) using a fastening member, such as a bolt.

Figure 7:
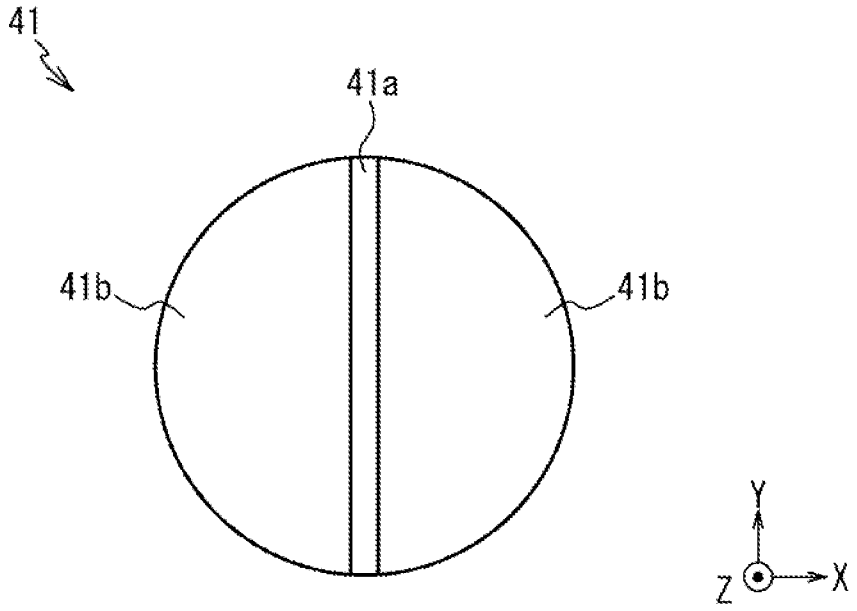
FIG. 7 is a schematic top view of a first membrane according to Embodiment 1.
Figure 8:
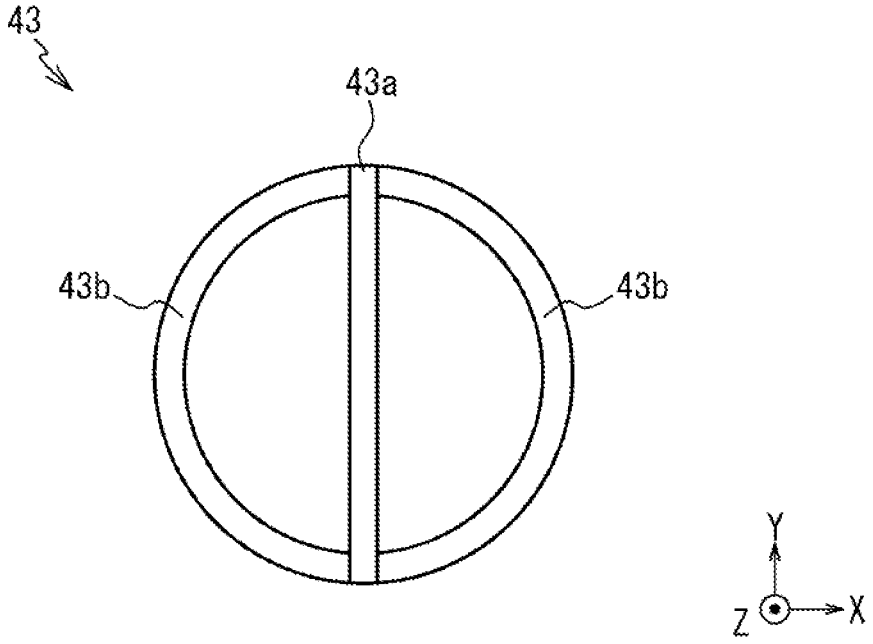
FIG. 8 is a schematic top view of a first support member according to Embodiment 1.
Figure 9:
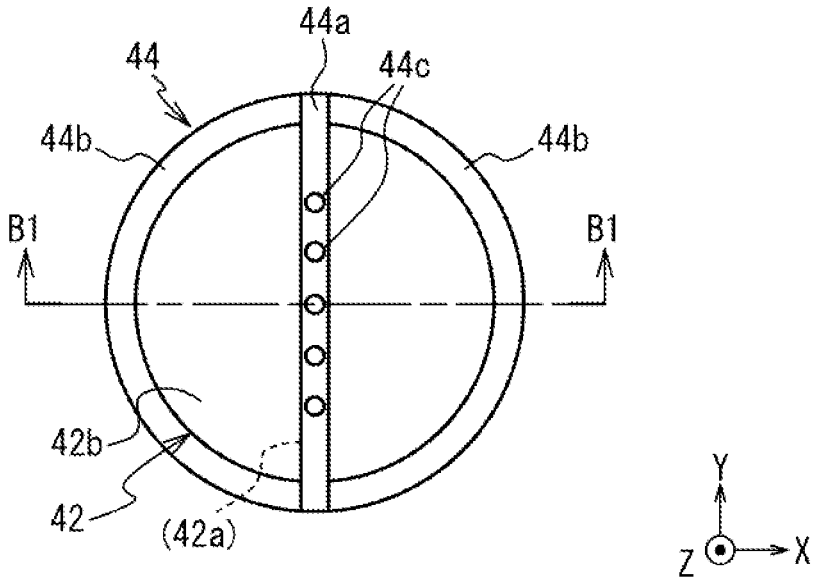
FIG. 9 is a schematic top view of a second membrane and a second support member according to Embodiment 1.
Figure 10:
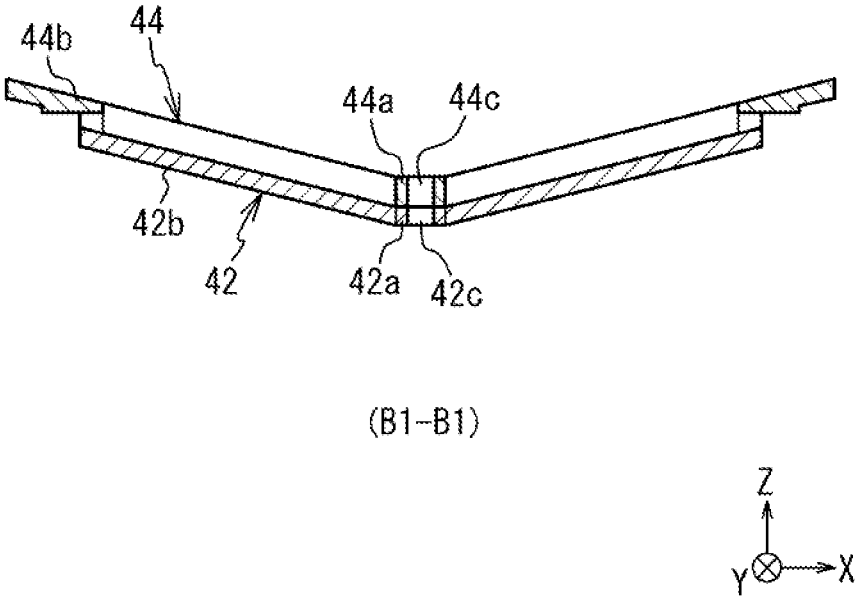
FIG. 10 is a cross-sectional view schematically illustrating a cross-sectional surface taken along a line B1-B1 of FIG. 9.
Figure 11:
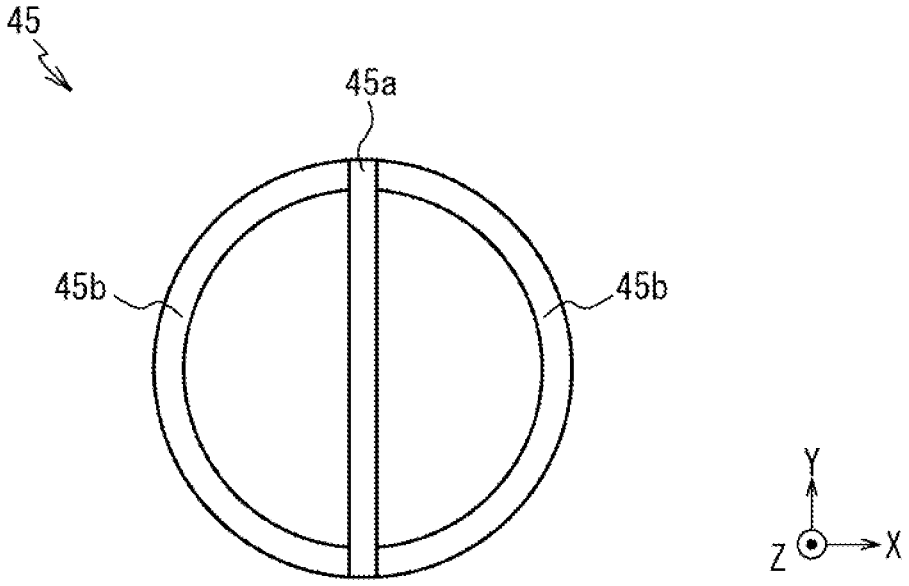
FIG. 11 is a schematic top view of a first sealing member according to Embodiment 1.
Figure 12:
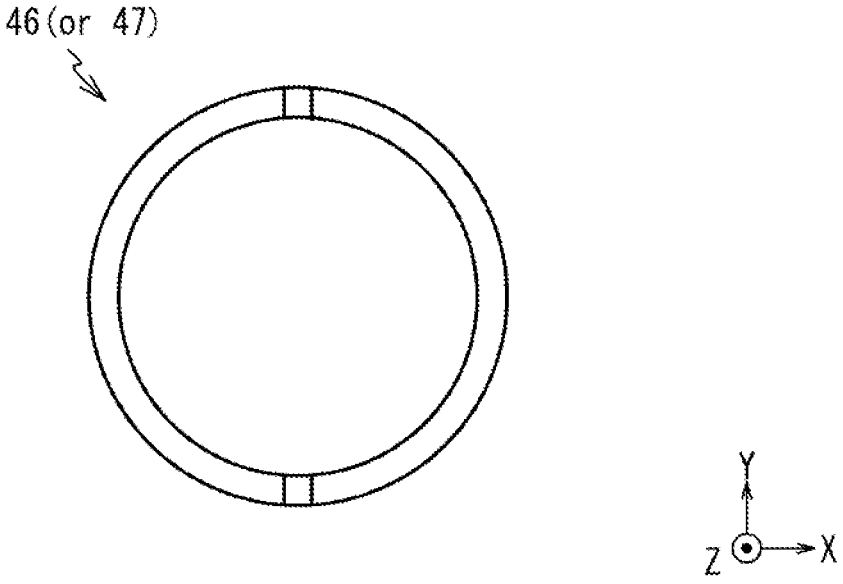
FIG. 12 is a schematic top view of a second sealing member or a third sealing member according to Embodiment 1.

FIG. 7 is a schematic top view of the first membrane 41. FIG. 8 is a schematic top view of the first support member 43. FIG. 9 is a schematic top view of the second membrane 42 and the second support member 44. FIG. 10 is a cross-sectional view schematically illustrating a cross-sectional surface taken along a line B1-B1 of FIG. 9. FIG. 11 is a schematic top view of the first sealing member 45. FIG. 12 is a schematic top view of the second sealing member 46 (or the third sealing member 47). FIG. 13 is a schematic enlarged cross-sectional view of a part A2 of FIG. 3.

The first membrane 41 is a membrane configured to allow ion species (which include metal ions) included in the plating solution Ps to pass through the first membrane 41 and suppress passing of a nonionic plating additive included in the plating solution Ps through the first membrane 41. Specifically, the first membrane 41 has a plurality of fine holes (micropores) (illustration of the micropores is omitted). An average diameter of the plurality of holes is a size of nanometer (that is, a size of 1 nm or more and 999 nm or less). This allows the ion species (which have a size of nanometer) including metal ions to pass through the plurality of micropores of the first membrane 41 while suppressing passing of the nonionic plating additive (which has a size larger than nanometer) through the plurality of micropores of the first membrane 41. As the first membrane 41, for example, an ion exchange membrane can be used. Examples of specific product names of the first membrane 41 include Nafion membranes manufactured by The Chemours Company.

As described in this embodiment, by including the first membrane 41 in the plating module 400, movement of the nonionic plating additive included in the plating solution Ps in the cathode chamber 12 to the anode chamber 11 can be suppressed. This can ensure a reduction in consumption amount of the plating additive in the cathode chamber 12.

As illustrated in FIG. 7, the first membrane 41 includes the extending portion 41*a* and inclined portions 41*b*. The extending portion 41*a* extends in the horizontal direction. Specifically, the extending portion 41*a* extends in the horizontal direction (the Y-direction as an example) while passing through the center of the anode chamber 11. The extending portion 41*a* is configured of a surface having a predetermined width (a length in the X-direction).

The inclined portions 41*b* extend from the extending portion 41*a* as a starting point to one side (an X-direction side) and the other side (a −X-direction side) in directions away from the extending portion 41*a* and incline so as to be positioned upward as separating from the extending portion 41*a*. As a result, the first membrane 41 according to this embodiment has a "V-shaped" appearance shape in front view (when viewed from the Y-direction). An outer edge of the inclined portion 41*b* according to this embodiment has an arc shape. Specifically, the outer edge of the inclined portion 41*b* has an arc shape in which parts of the outer edge are connected to both ends of the extending portion 4l*a* (an end portion on a Y-direction side and an end portion on a −Y-direction side). As a result, the first membrane 41 has an approximately circular shape in top view.

To give an example of an inclination angle relative to the horizontal direction of the inclined portions 41*b* of the first membrane 41, for example, a value of two degrees or more can be used as the inclination angle, and specifically, a value of two degrees or more and 45 degrees or less can be used.

As illustrated in FIG. 8, the first support member 43 is a member for supporting the first membrane 41. Specifically, the first support member 43 includes a first portion 43*a* that supports the extending portion 41*a* of the first membrane 41 and a second portion 43*b* that supports the outer edges of the inclined portions 41*b* of the first membrane 41. The first portion 43*a* extends in the horizontal direction. Specifically, the first portion 43*a* extends in the horizontal direction (the Y-direction as an example) while passing through the center of the anode chamber 11. The second portion 43*b* is configured of a circular member and inclines so as to be positioned upward as separating from the first portion 43*a*.

The first portion 43*a* according to this embodiment is positioned above the first membrane 41 and supports the first membrane 41 from the upper side.

As illustrated in FIG. 5, the first sealing member 45 is a sealing member that is sandwiched between the first membrane 41 and the first support member 43. Thus, by arranging the first sealing member 45 between the first membrane 41 and the first support member 43, the first membrane 41 and the first support member 43 are in a mutually non-contact state.

As illustrated in FIG. 11, the first sealing member 45 includes an extending sealing portion 45*a* and an outer edge sealing portion 45*b*. The extending sealing portion 45*a* extends in the horizontal direction and is sandwiched between the extending portion 41*a* of the first membrane 41 and the first portion 43*a* of the first support member 43. The outer edge sealing portion 45*b* is sandwiched between the outer edges of the inclined portions 41*b* of the first membrane 41 and the second portion 43*b* of the first support member 43.

With reference to FIG. 5 and FIG. 6, the second membrane 42 is arranged at a position below the first membrane 41 and above the anode 13 without contacting the fast membrane 41. A region below the second membrane 42 is referred to as a "first region R1", and a region above the second membrane 42 and below the first membrane 41 (a region between the second membrane 42 and the first membrane 41) is referred to as a "second region R2". The second region R2 allows the plating solution Ps to circulate in this region.

With reference to FIG. 5, FIG. 6, FIG. 9, and FIG. 10, the second membrane 42 according to this embodiment is bonded to the second support member 44. Specifically, the second membrane 42 according to this embodiment is bonded to a lower surface of the second support member 44 as an example.

The second membrane 42 is a membrane configured to allow the ion species (ion species including metal ions) included in the plating solution Ps to pass through the second membrane 42 and suppress passing of the gas bubbles Bu through the second membrane 42. Specifically, the second membrane 42 has a plurality of micropores (illustration of the micropores is omitted). An average diameter of the plurality of micropores is a size of nanometer. This allows the ion species including metal ions to pass through the micropores of the second membrane 42 while suppressing passing of the gas bubbles Bu (which have a size larger than nanometer) through the micropores of the second membrane 42.

It is preferred that a different kind of membrane from the fast membrane 41 is used for the second membrane 42. For example, the second membrane 42 can differ in material, surface property (such as hydrophobicity and hydrophilicity), surface roughness, dimension and density of the micropores, and the like from the first membrane 41. As one embodiment, as the first membrane 41, a membrane having excellent performance of suppressing movement of the plating additive that can be included in the plating solution Ps can be used, and as the second membrane 42, a membrane having an excellent flow feature of the gas bubbles Bu in which the gas bubbles Bu are difficult to attach can be used. The average diameter of the micropores of the second membrane 42 may have a size larger than the average diameter of the micropores of the first membrane 41.

Examples of the size of the average diameter of the micropores of the second membrane 42 include a value selected from a range of several tens of nm to several hundreds of nm (to give an example of this, for example, a value selected from a range of 10 nm to 300 nm). The surface roughness of the second membrane 42 is preferably small in a point that the gas bubbles Bu become difficult to attach. It is preferable to be a case where a surface of the second membrane 42 is hydrophilic in a point that the gas bubbles Bu become more difficult to attach than a case where the surface of the second membrane 42 is hydrophobic (generally, the gas bubbles Bu are hydrophobic). Examples of specific product names of the second membrane 42 include "Electrolytic Diaphragm For Plating" manufactured by Yuasa Membrane Systems Co., Ltd.

In the plating module 400 according to this embodiment, two kinds of ion permeable membranes, the first membrane 41 and the second membrane 42, are used. Depending on the kind of membrane, ion permeability, permeability of an additive, adherability of gas bubbles, and the like are each different, and with only one kind of membrane, it is difficult to fulfill a preferable function in the plating module 400 in some cases. Therefore, in the plating module 400 according to this embodiment, by using the two kinds of ion permeable membranes having different properties, improvement in the overall function of the plating module 400 can be ensured.

With reference to FIG. 3, FIG. 9, and FIG. 10, the second membrane 42 includes inclined portions 42*b* that incline relative to the horizontal direction and incline so as to be positioned upward as heading from the center side of the anode chamber 1110 an outer edge side of the anode chamber 11.

Specifically, the second membrane 42 according to this embodiment includes the above-described inclined portions 42*b* and an extending portion 42*a* that extends in the horizontal direction. The inclined portions 42*b* extend from the extending portion 42*a* as a starting point to one side (the X-direction side) and the other side (the −X-direction side) in directions away from the extending portion 42*a* and incline so as to be positioned upward as separating from the extending portion 42*a*. As a result, the second membrane 42 according to this embodiment has a "V-shaped" appearance shape in front view (when viewed from the Y-direction).

To give an example of an inclination angle relative to the horizontal direction of the inclined portions 42*b* of the second membrane 42, for example, a value of two degrees or more can be used as the inclination angle, and specifically, a value of two degrees or more and 45 degrees or less can be used.

An outer edge of the inclined portion 42*b* according to this embodiment has an arc shape. Specifically, the outer edge of the inclined portion 42*b* has an arc shape in which parts of the outer edge are connected to both ends of the extending portion 42*a* (an end portion on the Y-direction side and an end portion on the −Y-direction side). As a result, the second membrane 42 has an approximately circular shape in top view. The inclined portions 42*b* of the second membrane 42 according to this embodiment are approximately parallel to the inclined portions 41*b* of the first membrane 41.

The extending portion 42*a* extends in the horizontal direction (the Y-direction as an example) while passing through the center of the anode chamber 11. The extending portion 42*a* is configured of a surface having a predetermined width (a length in the X-direction). The extending portion 42*a* is bonded to a lower surface of a first portion 44*a* described later of the second support member 44.

In the extending portion 42*a* of the second membrane 42, inflow ports 42*c* (which are illustrated in, for example, FIG. 6 and FIG. 10) are disposed for causing the plating solution Ps below the second membrane 42 to flow into the region above the second membrane 42 and below the first membrane 41. Specifically, a plurality of the inflow ports 42*c* according to this embodiment are disposed in the extending direction of the extending portion 42*a* of the second membrane 42.

The dimension of the inflow port 42*c* (that is, an opening dimension) is preferably 2 mm or more in the shortest dimension and 15 mm or less in the longest dimension. Specifically, when the inflow port 42*c* has, for example, a circular shape, the diameter is preferably 2 mm or more and 15 mm or less. When the inflow port 42*c* has, for example, a rectangular shape, the length of a side of the rectangular is preferably 2 mm or more and 15 mm or less. The number of the inflow ports 42*c* having such a preferable dimension may be one or plural. The first region R1 and the second region R2 of the anode chamber 11 are fluid-connected by the inflow ports 42*c*.

A lower surface of the inclined portion 42*b* of the second membrane 42 is preferably smoother than a lower surface of the inclined portion 41*b* of the first membrane 41. In other words, the surface roughness (Ra) of the lower surface of the inclined portion 42*b* of the second membrane 42 is preferably smaller than the surface roughness (Ra) of the lower surface of the inclined portion 41*b* of the first membrane 41. With this configuration, the gas bubbles Bu can be effectively moved along the lower surfaces of the inclined portions 42*b* of the second membrane 42. This can effectively suppress deterioration of the plating quality of the substrate Wf due to the gas bubbles Bu.

The second support member 44 is a member for supporting the second membrane 42. Specifically, the second support member 44 includes the first portion 44*a* that supports the extending portion 42*a* of the second membrane 42 and a second portion 44*b* that supports the outer edges of the inclined portions 42*b* of the second membrane 42. The first portion 44*a* extends in the horizontal direction. Specifically, the first portion 44*a* extends in the horizontal direction (the Y-direction as an example) while passing through the center of the anode chamber 11. The second portion 44*b* is configured of a circular member and inclines so as to be positioned upward as separating from the first portion 44*a*.

At positions in the first portion 44*a* corresponding to the inflow ports 42*c* of the second membrane 42, holes 44*c* arranged so as to communicate with the inflow ports 42*c* are disposed. This causes the inflow ports 42*c* not to be obstructed by the first portion 44*a*.

As illustrated in FIG. 5 and FIG. 12, the second sealing member 46 is a sealing member arranged so as to be sandwiched between the first membrane 41 and the second support member 44. The third sealing member 47 is a sealing member arranged so as to be sandwiched between the second sift member 44 and the secured position of the outer peripheral wall 10*b* of the plating tank 10.

In this embodiment, the shapes of the second sealing member 46 and the third sealing member 47 are identical. Specifically, as illustrated in FIG. 12, the second sealing member 46 and the third sealing member 47 have a circular shape as a whole in top view. The second sealing member 46 is sandwiched between the outer edges of the inclined portions 41*b* of the first membrane 41 and the second portion 44*b* of the second support member 44. The third sealing member 47 is sandwiched between the second portion 44*b* of the second support member 44 and the secured position of the outer peripheral wall 10*b* of the plating tank 10.

With this embodiment as described above, the second membrane 42 as described above is included, and therefore, as illustrated in FIG. 13, even when the gas bubbles Bu are generated in the anode chamber 11, the gas bubbles Bu can be moved along the inclined portions 42*b* of the second membrane 42 using buoyancy and moved to the outer edge of the second membrane 42. This can suppress remaining of the gas bubbles Bu generated in the anode chamber 11 entirely on the lower surfaces of the first membrane 41 and the second membrane 42. As a result, deterioration of the plating quality of the substrate Wf due to the gas bubbles Bu remaining entirely on the lower surfaces of the first membrane 41 and the second membrane 42 can be suppressed.

Figure 14:
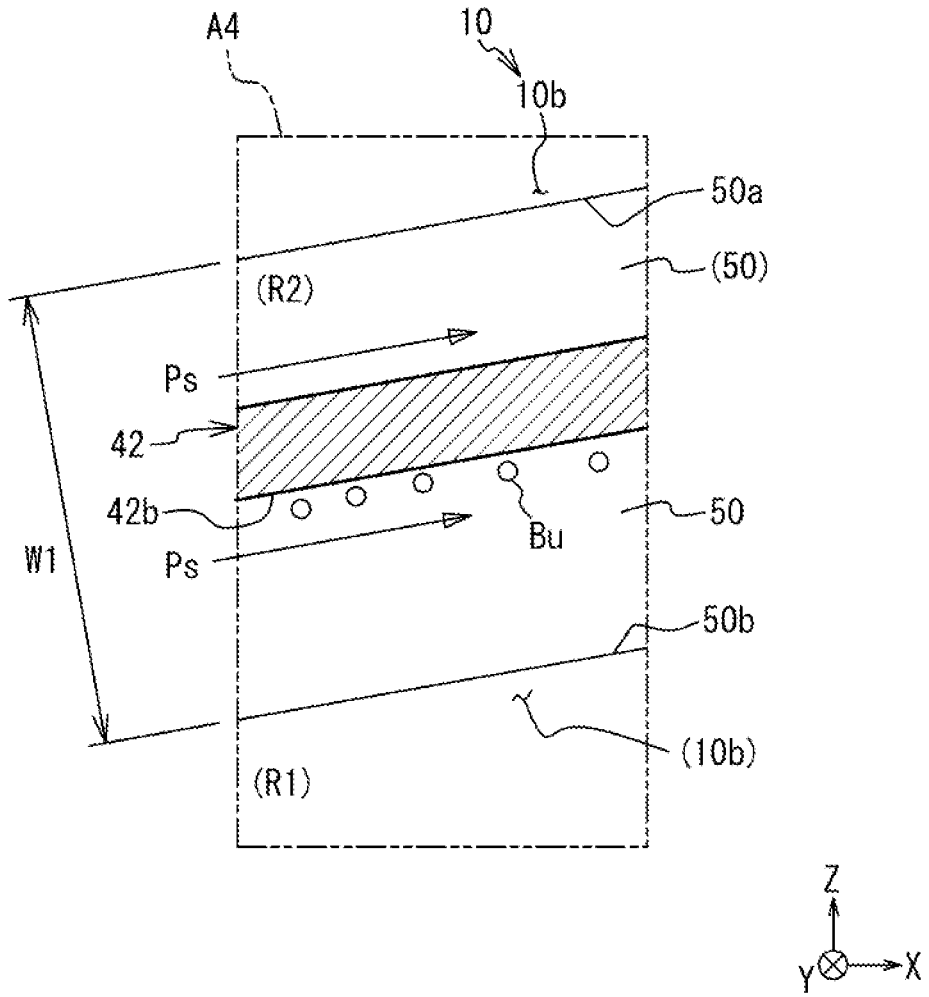
FIG. 14 is a schematic enlarged view of a part A4 of FIG. 13.

FIG. 14 is a schematic enlarged view of a part A4 of FIG. 13. With reference to FIG. 13 and FIG. 14, in the outer peripheral wall 10*b* of the plating tank 10, a housing groove 50 is disposed. The housing groove 50 is formed in the outer peripheral wall 10*b* of the plating tank 10 so as to be along the outer edges of the inclined portions 42*b* of the second membrane 42. Specifically, the housing groove 50 according to this embodiment is formed on the whole circumference in the circumferential direction of the outer peripheral wall 10*b* so as to be along the outer edges of the inclined portions 42*b* of the second membrane 42.

The housing groove 50 is configured to temporarily house the gas bubbles Bu moved to the outer edges of the inclined portions 42*b* of the second membrane 42 and configured to cause the plating solution Ps in the first region R1 and the plating solution Ps in the second region R2 to join together in the housing groove 50.

Specifically, as illustrated in FIG. 14, the housing groove 50 according to this embodiment is formed such that an upper side groove wall 50*a* is positioned above the second membrane 42, and a lower side groove wall 50*b* opposed to the upper side groove wall 50*a* is positioned below the second membrane 42. This allows the housing groove 50 to effectively house the gas bubbles Bu moved to the outer edges of the inclined portions 42*b* along the inclined portions 42*b* of the second membrane 42 and can facilitate joining the plating solution Ps in the first region R1 and the second region R2 together in the housing groove 50.

While the distance between the upper side groove wall 50*a* and the lower side groove wall 50*b* (that is, a groove width W1) is not particularly limited, in this embodiment, the distance is set to a value selected from a range of 2 mm or more and 30 mm or less as an example.

With reference to FIG. 13, the housing groove 50 communicates with the anode chamber discharge ports 17 described later through communication passages 51. Specifically, the communication passage 51 communicates between an upper end of the housing groove 50 and an upstream end of the anode chamber discharge port 17.

The anode chamber discharge port 17 communicates with the housing groove 50 via the communication passage 51 disposed in the outer peripheral wall 10*b* of the plating tank 10. The anode chamber discharge port 17 is configured to suction the plating solution Ps in the first region R1 and the plating solution Ps in the second region R2 together with the gas bubbles Bu housed in the housing groove 50 and discharge them to the outside of the plating tank 10.

Specifically, the anode chamber discharge port 17 according to this embodiment communicates with a part positioned on the uppermost side of the housing groove 50 via the communication passage 51 disposed in the outer peripheral wall 10*b* of the plating tank 10. At a part of the second portion 44*b* of the second support member 44, a groove 44*d* (or a hole may be applied) is disposed for causing the plating solution Ps in the second region R2 flowing along an upper surface of the second membrane 42 to flow into the communication passage 51. The plating solution Ps in the first region R1 and the plating solution Ps in the second region R2 flow along the second membrane 42, then join together and flow into the communication passages 51, and next, are discharged from the anode chamber discharge ports 17. Note that the total of two anode chamber discharge ports 17 according to this embodiment are disposed.

With this embodiment, the gas bubbles Bu moved to the outer edges of the inclined portions 42*b* of the second membrane 42 can be temporarily housed in the housing groove 50, and the housed gas bubbles Bu can be discharged from the anode chamber discharge ports 17 to the outside of the plating tank 10 together with the plating solution Ps in the first region R1 and the second region R2. This can effectively suppress remaining of the gas bubbles Bu on the lower surface of the second membrane 42.

With this embodiment, the gas bubbles Bu are temporarily housed in the housing groove 50, and therefore, a plurality of small gas bubbles Bu can be joined and made into large gas bubbles Bu in the housing groove 50. This can make it easier to discharge the gas bubbles Bu from the anode chamber discharge ports 17.

As illustrated in FIG. 13, the communication passage 51 may be configured such that the cross-sectional area of the communication passage 51 decreases as heading to the downstream side. Since this configuration makes it easier for the gas bubbles Bu to temporarily remain in the housing groove 50, in the housing groove 50, the plurality of small gas bubbles Bu can be effectively joined and made into the large gas bubbles Bu. This can effectively discharge the gas bubbles Bu from the anode chamber discharge ports 17.

Embodiment 2

Figure 15:
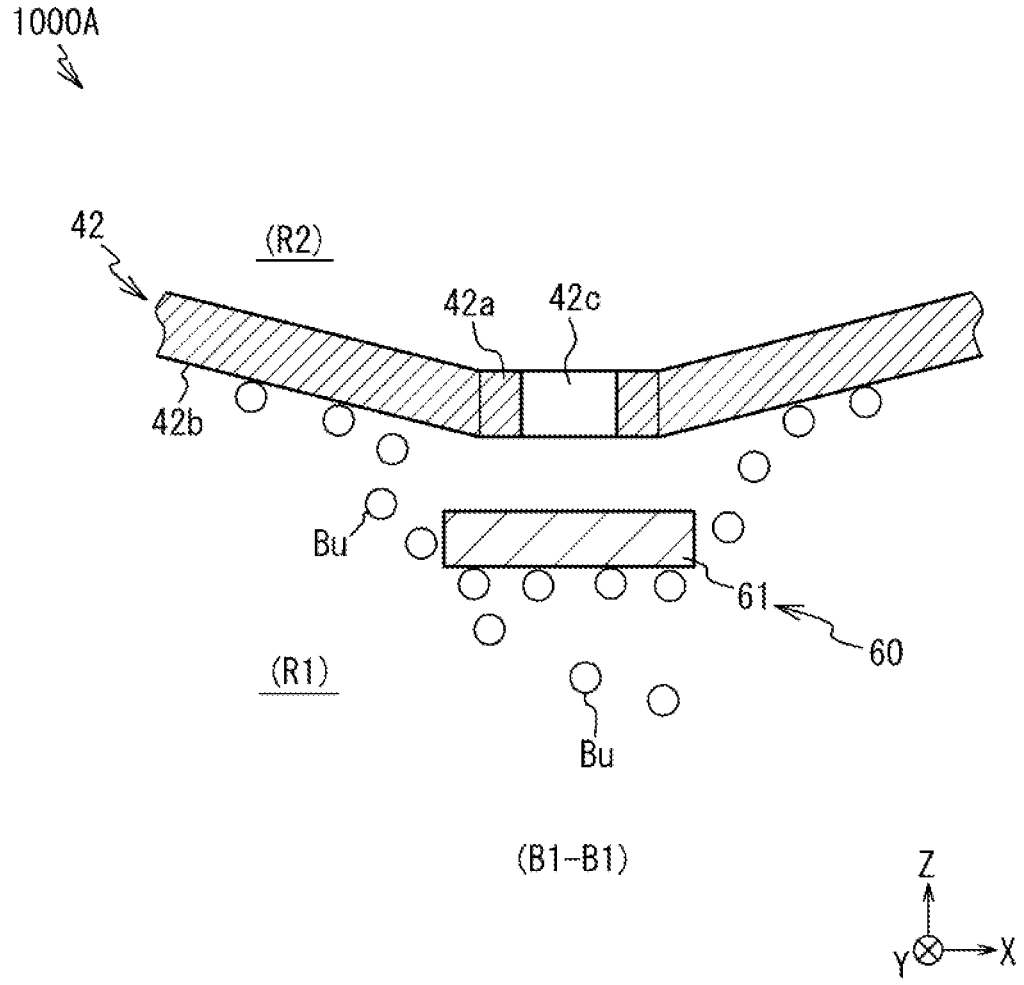
FIG. 15 is a cross-sectional view schematically illustrating a peripheral configuration of a second membrane of a plating apparatus according to Embodiment 2.

Subsequently, Embodiment 2 of the present invention will be described. In the following description, similar reference numerals are attached to configurations similar to those in Embodiment 1 described above, and the description will be omitted (which also applies to Embodiment 3 described later). FIG. 15 is a cross-sectional view schematically illustrating a peripheral configuration of a second membrane 42 of a plating apparatus 1000A according to this embodiment. In FIG. 15, illustration of the second support member 44 and the like is omitted.

The plating apparatus 1000A according to this embodiment is different from the plating apparatus 1000 according to Embodiment 1 described above in a point that a suppressing member 60 configured to suppress flowing of the gas bubbles Bu present in the first region R1 of the anode chamber 11 into the inflow ports 42*c* of the second membrane 42 is further included.

Specifically, the suppressing member 60 according to this embodiment includes a suppressing plate 61 configured of a plate member arranged below the inflow ports 42*c* of the second membrane 42 and extending in the horizontal direction. The suppressing plate 61 according to this embodiment is configured of the plate member having a larger area than the inflow ports 42*c*. This entirely hides the inflow ports 42*c* by the suppressing plate 61 when the suppressing plate 61 is viewed from the lower side. For example, the position of the suppressing plate 61 may be secured by being connected to the second support member 44 via a connecting member (not illustrated).

With this embodiment, flowing of the gas bubbles Bu in the first region R1 into the inflow ports 42*c* can be suppressed by the above-described suppressing member 60. Specifically, the gas bubbles Bu moving up toward the inflow ports 42*c* contact a lower surface of the suppressing plate 61, thereby allowing suppressing flowing of the gas bubbles Bu into the inflow ports 42*c*. This can suppress flowing of the gas bubbles Bu in the first region R1 into the second region R2 from the inflow ports 42*c*.

Modification of Embodiment 2

Figure 16:
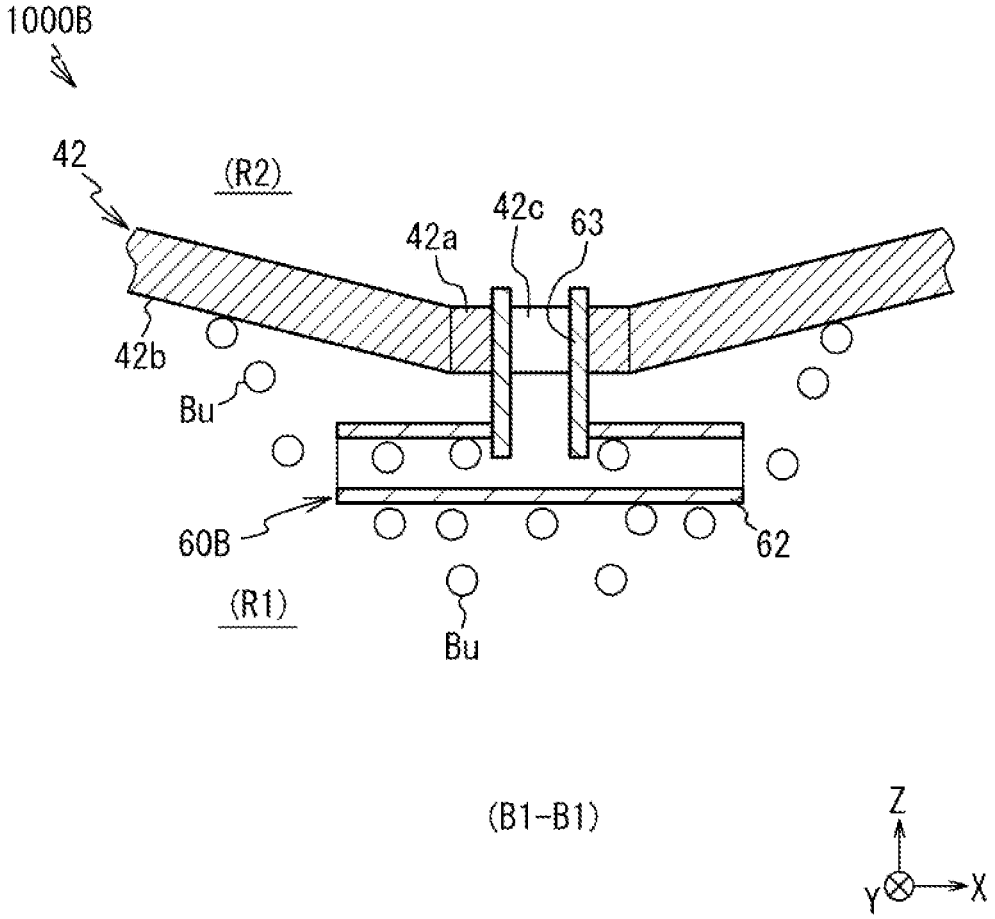
FIG. 16 is a cross-sectional view schematically illustrating a peripheral configuration of a second membrane of a plating apparatus according to a modification of Embodiment 2.

FIG. 16 is a cross-sectional view schematically illustrating a peripheral configuration of a second membrane 42 of a plating apparatus 1000B according to a modification of Embodiment 2. In FIG. 16, illustration of the second support member 44 and the like is omitted. The plating apparatus 1000B according to this modification includes a suppressing member 60B instead of the suppressing member 60.

The suppressing member 60B includes a tubular member 62 and a coupling member 63. The tubular member 62 is configured of a tubular member arranged below the inflow ports 42*c* of the second membrane 42 and extending in the horizontal direction (a direction of the X-axis in FIG. 16). The coupling member 63 is a tubular member configured to couple an inside of the tubular member 62 to the inflow ports 42*c*. As exemplified in FIG. 16, a lower end of the coupling member 63 may pass through a tube side wall of the tubular member 62 and project to the inside of the tubular member 62. The plating solution Ps in the anode chamber 11 passes through the inside of the tubular member 62 and an inside of the coupling member 63 in this order, and afterwards, flows into the inflow ports 42*c*.

With this modification, the gas bubbles Bu moving up toward the inflow ports 42*c* contact a lower surface of the tubular member 62 (a lower surface of a tube outer wall) and an upper surface of a tube inner wall, thereby allowing suppressing flowing of the gas bubbles Bu into the inflow ports 42*c*. This can suppress flowing of the gas bubbles Bu in the first region R1 into the second region R2 from the inflow ports 42*c*.

Additionally, with this modification, as described above, a lower end of the coupling member 63 projects to the inside of the tubular member 62. Therefore, even if the gas bubbles Bu invade the inside of the tubular member 62, the gas bubbles Bu contact a part of the coupling member 63 projecting to the inside of the tubular member 62, thereby allowing suppressing invasion of the gas bubbles Bu to the inside of the coupling member 63. This can effectively suppress flowing of the gas bubbles Bu inside the tubular member 62 into the second region R2.

Embodiment 3

Figure 17:
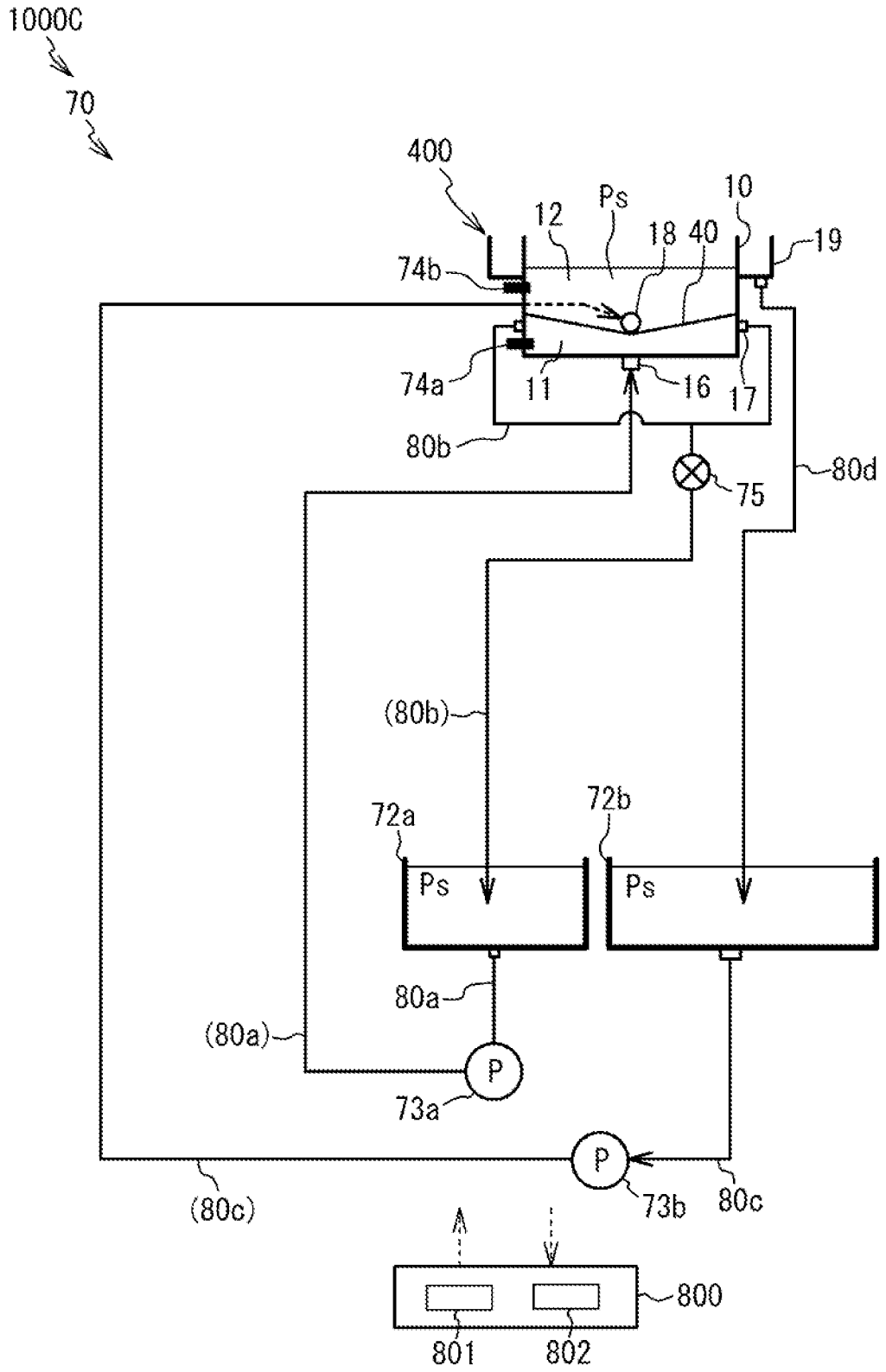
FIG. 17 is a schematic diagram for describing a plating solution circulation module according to Embodiment 3.

Subsequently, a plating apparatus 10000 according to Embodiment 3 of the present invention will be described. FIG. 17 is a schematic diagram for describing a plating solution circulation module 70 included in the plating apparatus 10000 according to this embodiment. Note that the plating solution circulation module 70 of FIG. 17 may be applied to the plating module 400 according to Embodiment 1 and may be applied to the plating module 400 according to Embodiment 2.

The plating solution circulation module 70 according to this embodiment mainly includes reservoir tanks 72*a* and 72*b*, pumps 73*a* and 73*b*, pressure gauges 74*a* and 74*b*, a pressure regulating valve 75, flow passages 80*a*, 80*b*, 80*c*, and 80*d*, and the like. The operation of the plating solution circulation module 70 is controlled by the control module 800. In this embodiment, of the control function of the control module 800, a functional portion that controls the plating solution circulation module 70 is included in a pact of constituent elements of the plating solution circulation module 70.

The control module 800 that controls the plating solution circulation module 70 includes a processor 801 and a non-transitory storage device 802. The storage device 802 stores programs, data, and the like. In the control module 800, the processor 801 controls the plating solution circulation module 70 based on a command of the program stored in the storage device 802.

The reservoir tank 72*a* is a tank for temporarily accumulating the plating solution Ps for the anode chamber 11. That is, the reservoir tank 72*a* is a "reservoir tank for the anode chamber 11". The reservoir tank 72*b* is a tank configured to temporarily accumulate the plating solution Ps for the cathode chamber 12. That is, the reservoir tank 72*b* is a "reservoir tank for the cathode chamber 12".

The flow passage 80*a* is a flow passage for circulating the plating solution Ps in the reservoir tank 72*a* to the anode chamber 11. The flow passage 80*b* is a flow passage for circulating (retuning) the plating solution Ps in the anode chamber 11 to the reservoir tank 72*a*. The flow passage 80*c* is a flow passage for circulating the plating solution Ps in the reservoir tank 72*b* to the cathode chamber 12. The flow passage 80*b* is a flow passage for returning the plating solution Ps that has overflowed from the cathode chamber 12 and flowed into the overflow tank 19 to the reservoir tank 72*b* from the overflow tank 19.

The pump 73*a* is a pump for pressure-feeding the plating solution Ps in the reservoir tank 72*a* toward the anode chamber 11. The pump 73*a* according to this embodiment is arranged at a position in the middle of the flow passage 80*a*. The pump 73*b* is a pump for pressure-feeding the plating solution Ps in the reservoir tank 72*b* toward the cathode chamber 12. The pump 73*b* according to this embodiment is arranged at a position in the middle of the flow passage 80*c*. The operations of the pump 73*b* and the pump 73*a* are controlled by the control module 800.

The pressure gauge 74*a* detects a pressure in the anode chamber 11 (specifically, a pressure of the plating solution Ps in the anode chamber 11) and transmits the detection result to the control module 800. The pressure gauge 74*b* detects a pressure in the cathode chamber 12 (specifically, a pressure of the plating solution Ps in the cathode chamber 12) and transmits the detection result to the control module 800.

At least in performing the plating process on the substrate Wf, the plating solution circulation module 70 circulates the plating solution Ps between the anode chamber 11 and the reservoir tank 72*a* and circulates the plating solution Ps between the cathode chamber 12 and the reservoir tank 72*b*.

Specifically, the control module 800 according to this embodiment activates the pump 73*a* and the pump 73*b* at least in performing the plating process. By activating the pump 73*a*, the plating solution Ps in the reservoir tank 72*a* circulates through the flow passage 80*a* and is supplied to the anode chamber 11. The plating solution Ps discharged from the anode chamber 11 circulates through the flow passage 80*b* and returns to the reservoir tank 72*a*. By activating the pump 73*b*, the plating solution Ps in the reservoir tank 72*b* circulates through the flow passage 80*c* and is supplied to the cathode chamber 12. The plating solution Ps that has overflowed from the cathode chamber 12 and flowed into the overflow tank 19 circulates through the flow passage 80*d* and returns to the reservoir tank 72*b*.

The pressure regulating valve 75 is arranged at a position in the middle of the flow passage 80*b*. The pressure regulating valve 75 regulates the pressure (Pa) in the anode chamber 11 by regulating a pressure (Pa) of the plating solution Ps circulating through the flow passage 80*b*. Specifically, when the pressure regulating valve 75 increases the pressure of the plating solution Ps circulating through the flow passage 80*b*, the pressure in the anode chamber 11 increases. On the other hand, when the pressure regulating valve 75 lowers the pressure of the plating solution Ps circulating through the flow passage 80*b*, the pressure in the anode chamber 11 also lowers.

The pressure regulating valve 75 according to this embodiment regulates the pressure in the anode chamber 11 such that the pressure in the anode chamber 11 has a value identical to a value of the pressure in the cathode chamber 12. In this case, in performing the plating process, the pump 73*a* does not operate by feedbackiug the pressure in the anode chamber 11 and the pressure in the cathode chamber 12, but continues to pressure-feed the plating solution Ps at a constant rotational speed.

With this configuration, the pressure in the anode chamber 11 can be regulated to be the value identical to the value of the pressure in the cathode chamber 12 in performing the plating process with a simple configuration of regulation by the pressure regulating valve 75.

Usually, in performing the plating process, the pressure in the cathode chamber 12 is a pressure (a constant value) slightly higher than the atmospheric pressure. In view of this, the plating solution circulation module 70 can be configured not to include the pressure gauge 74*b*. Specifically, in this case, it is only necessary to use a preset predetermined pressure as the pressure in the cathode chamber 12.

Although the embodiments of the present invention have been described in detail above, the present invention is not limited to such specific embodiments, and further various kinds of variants and modifications are possible within the scope of the present invention described in the claims.

REFERENCE SIGNS LIST

10 . . . plating tank
10*a* . . . bottom wall
10*b* . . . outer peripheral wall
11 . . . anode chamber
12 . . . cathode chamber
13 . . . anode
14 . . . ionically resistive element
17 . . . anode chamber discharge port
18 . . . supply/drain port ("drain port")
20 . . . substrate holder
30 . . . electric field adjusting block
40 . . . membrane module
41 . . . first membrane
41*a* . . . extending portion
41*b* . . . inclined portion
42 . . . second membrane
42*a* . . . extending portion
42*b* . . . inclined portion
42*c* . . . inflow port
43 . . . first support member ("first membrane support member")
44 . . . second support member ("second membrane support member")
50 . . . housing groove
60 . . . suppressing member
61 . . . suppressing plate
62 . . . tubular member
63 . . . coupling member
70 . . . plating solution circulation module
72*a*, 72*b* . . . reservoir tank
75 . . . pressure regulating valve
80*a* to 80*d* . . . flow passage
800 . . . control module
1000 . . . plating apparatus
Wf . . . substrate
Ps . . . plating solution
Bu . . . gas bubbles
R1 . . . first region
R2 . . . second region

The invention claimed is:

1. A plating apparatus comprising:

a plating tank having a bottom wall and an outer peripheral wall extending upward from an outer edge of the bottom wall, the plating tank being configured to accumulate a plating solution and have an anode arranged therein;

a substrate holder arranged above the anode, the substrate holder being configured to hold a substrate as a cathode such that the substrate is opposed to the anode; and a membrane module arranged above the anode and below the substrate, wherein the membrane module includes a first membrane configured to partition an inside of the plating tank into an anode chamber and a cathode chamber below the anode chamber, and a second membrane arranged at a position below the first membrane and above the anode without contacting the first membrane, and the second membrane has an inflow port for causing a plating solution in a first region below the second membrane to flow into a second region above the second membrane and below the first membrane, and an inclined portion inclining relative to a horizontal direction and inclining so as to be positioned upward as heading from a center side of the anode chamber to an outer edge side of the anode chamber.

2. The plating apparatus according to claim 1, wherein the first membrane includes an extending portion extending in the horizontal direction, and inclined portions extending from the extending portion as a starting point to one side and another side in a direction away from the extending portion and inclining so as to be positioned upward as separating from the extending portion.

3. The plating apparatus according to claim 2, wherein the outer peripheral wall of the plating tank is provided with a drain port for discharging a plating solution in the cathode chamber from the cathode chamber, and the drain port is disposed such that a height from the extending portion of the first membrane to the drain port is within 20 mm.

4. The plating apparatus according to claim 1, wherein the membrane module further includes a second membrane support member configured to support the second membrane.

5. The plating apparatus according to claim 1, wherein the membrane module further includes a first membrane support member configured to support the first membrane.

6. The plating apparatus according to claim 1, further comprising a housing groove formed in the outer peripheral wall of the plating tank so as to be along an outer edge of the inclined portion of the second membrane, wherein the housing groove is configured to temporarily house gas bubbles moved to the outer edge of the inclined portion of the second membrane and configured to cause a plating solution in the first region and a plating solution in the second region to join together in the housing groove, and the plating apparatus further includes an anode chamber discharge port communicating with the housing groove, the anode chamber discharge port being configured to suction the gas bubbles housed in the housing groove together with a plating solution flowing through the housing groove and discharge the gas bubbles and the plating solution to an outside of the plating tank.

7. The plating apparatus according to claim 1, further comprising:

an ionically resistive element arranged below the substrate in the cathode chamber; and a ring-shaped electric field adjusting block for adjusting an electric field in the cathode chamber, the electric field adjusting block being arranged below the ionically resistive element in the cathode chamber and above the membrane module, wherein the ionically resistive element is provided with a plurality of through holes disposed so as to pass through a lower surface and an upper surface of the ionically resistive element, and the electric field adjusting block has an inner diameter smaller than an outer diameter of a punching area as an area where the plurality of through holes are disposed in the ionically resistive element.

8. The plating apparatus according to claim 1, further comprising a suppressing member configured to suppress flowing of gas bubbles in the first region into the inflow port.

9. The plating apparatus according to claim 8, wherein the suppressing member includes a suppressing plate arranged below the inflow port of the second membrane and extending in a horizontal direction.

10. The plating apparatus according to claim 8, wherein the suppressing member includes:

a tubular member arranged below the inflow port of the second membrane and extending in a horizontal direction; and a coupling member configured to couple an inside of the tubular member to the inflow port.

11. The plating apparatus according to claim 1, further comprising a plating solution circulation module configured to circulate a plating solution between the anode chamber and a reservoir tank for anode chamber and circulate a plating solution between the cathode chamber and a reservoir tank for cathode chamber in performing a plating process on the substrate.

12. The plating apparatus according to claim 11, wherein the plating solution circulation module includes a pressure regulating valve arranged in a flow passage configured to circulate a plating solution in the anode chamber to the reservoir tank for anode chamber, the pressure regulating valve being configured to regulate a pressure in the anode chamber such that the pressure in the anode chamber has a value identical to a value of a pressure in the cathode chamber.

* * * * *